US006135364A

United States Patent [19]

Nickish

[11] Patent Number: 6,135,364

[45] Date of Patent: Oct. 24, 2000

[54] ROTATOR AIR MANAGEMENT SYSTEM

[75] Inventor: Kirk Nickish, Walla Walla, Wash.

[73] Assignee: Nelson Irrigation Corporation, Walla Walla, Wash.

[21] Appl. No.: 09/241,090

[22] Filed: Feb. 1, 1999

[51] Int. Cl.[7] ..... B05B 3/04

[52] U.S. Cl. ..... 239/222.17; 239/518; 188/290; 188/322.5

[58] Field of Search ..... 239/222.17, 518, 239/DIG. 1, 252; 188/290, 322.5

[56] References Cited

U.S. PATENT DOCUMENTS

| | | | |
|---|---|---|---|
| Re. 33,823 | 2/1992 | Nelson et al. . | |
| 1,435,140 | 11/1922 | Rolland | 239/252 |
| 1,642,910 | 9/1927 | Thompson | 239/252 |
| 1,950,712 | 3/1934 | Coles et al. . | |
| 2,108,787 | 2/1938 | Coles et al. . | |
| 3,029,028 | 4/1962 | Skerritt | 239/252 |
| 3,052,574 | 9/1962 | Kennedy, Jr. | 239/252 |
| 3,415,258 | 12/1968 | Gilson . | |
| 3,468,485 | 9/1969 | Bully . | |
| 3,861,503 | 1/1975 | Nash . | |
| 3,865,216 | 2/1975 | Gryglas . | |
| 4,121,769 | 10/1978 | Drori . | |
| 4,198,001 | 4/1980 | Rodriguez | 239/252 |
| 4,356,972 | 11/1982 | Vikre . | |
| 4,440,345 | 4/1984 | Figwer et al. . | |
| 4,498,628 | 2/1985 | Tucker . | |
| 4,560,108 | 12/1985 | Rubinstein . | |
| 4,565,266 | 1/1986 | Omata . | |
| 4,660,766 | 4/1987 | Nelson et al. . | |
| 4,796,811 | 1/1989 | Davisson . | |
| 4,815,662 | 3/1989 | Hunter | 239/222.17 |
| 4,886,211 | 12/1989 | Cohen . | |
| 4,971,250 | 11/1990 | Hunter | 239/222.17 |
| 4,986,474 | 1/1991 | Schisler et al. . | |
| 5,007,586 | 4/1991 | Cohen . | |
| 5,224,653 | 7/1993 | Nelson et al. . | |
| 5,372,307 | 12/1994 | Sesser . | |
| 5,377,914 | 1/1995 | Christen | 239/252 |

FOREIGN PATENT DOCUMENTS

| | | |
|---|---|---|
| 1321580 | 2/1962 | France . |
| 1632916 | 8/1970 | Germany . |
| 476072 | 11/1952 | Italy . |

*Primary Examiner*—Andres Kashnikow
*Assistant Examiner*—Christopher S. Kim
*Attorney, Agent, or Firm*—Nixon & Vanderhye P.C.

[57] ABSTRACT

In a rotational speed viscous dampening device comprising a housing, a shaft having one end located in the housing and rotatable relative thereto, and a rotor body on the one end of the shaft with viscous fluid at least partially filling the housing, an improvement includes various rotor configurations for managing air within the housing so that the air does not interfere with viscous shearing of molecules of the viscous fluid between the rotor body and an interior wall of the housing. The viscous dampening device may be used to control the speed of rotation of a stream distributor component of a sprinkler.

6 Claims, 10 Drawing Sheets

FIG. 7
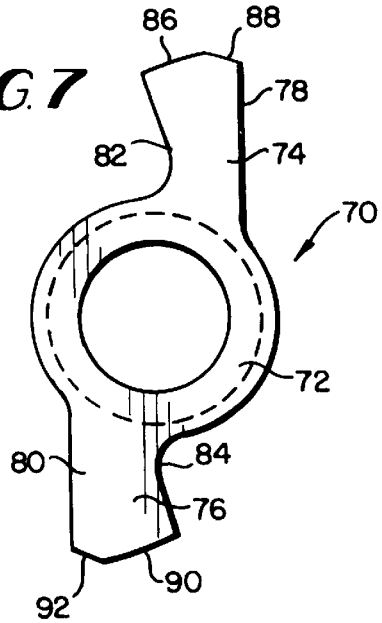
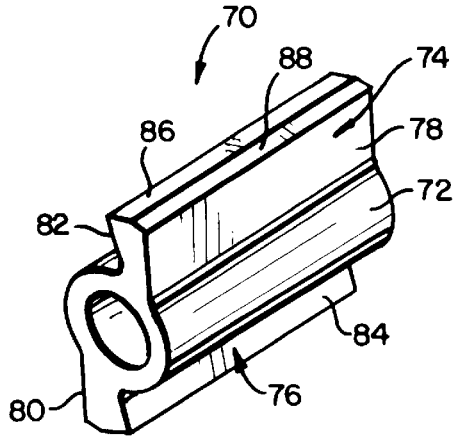
FIG. 8
FIG. 9
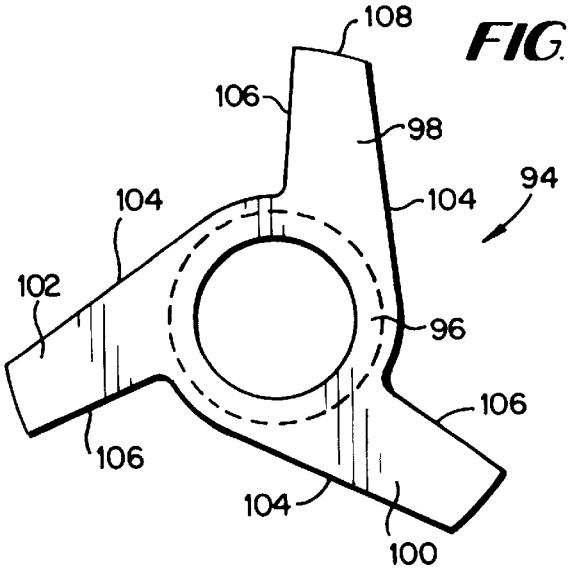
FIG. 10
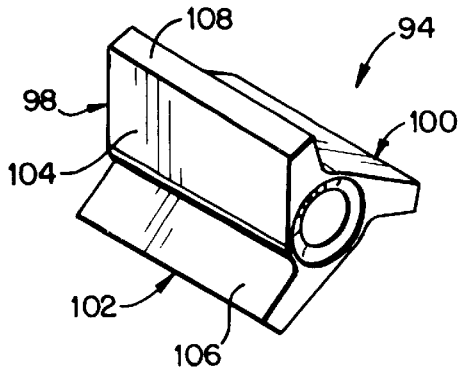

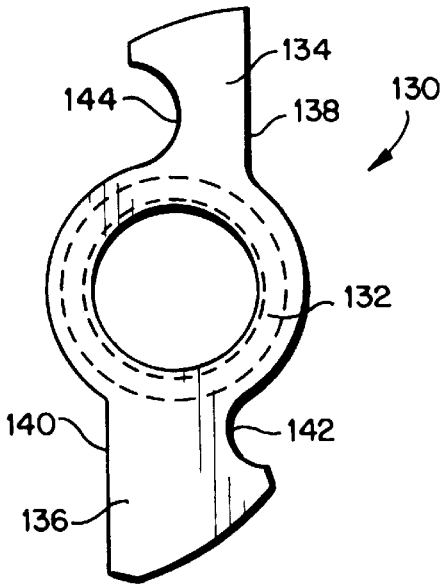
FIG. 15
FIG. 16
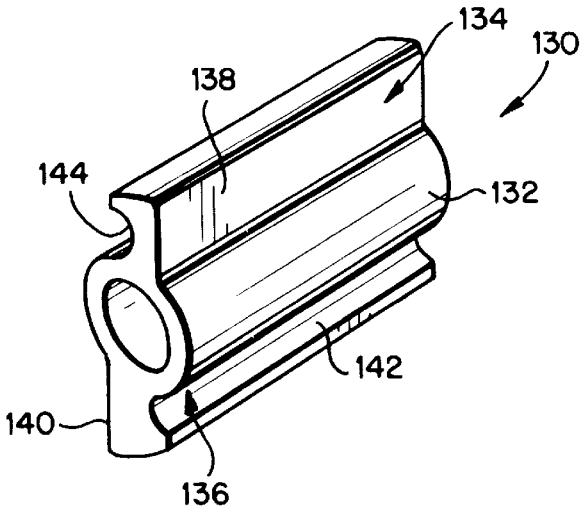
FIG. 17
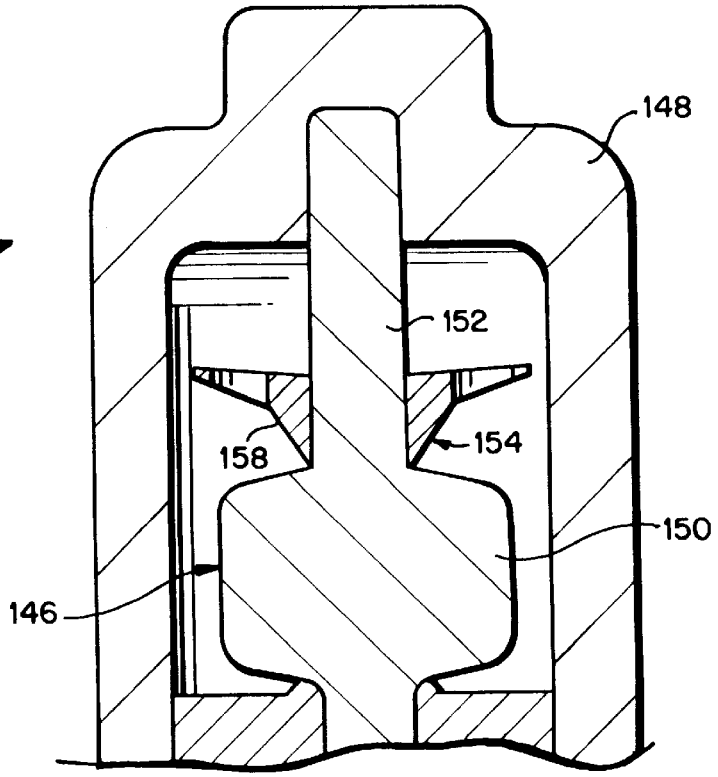

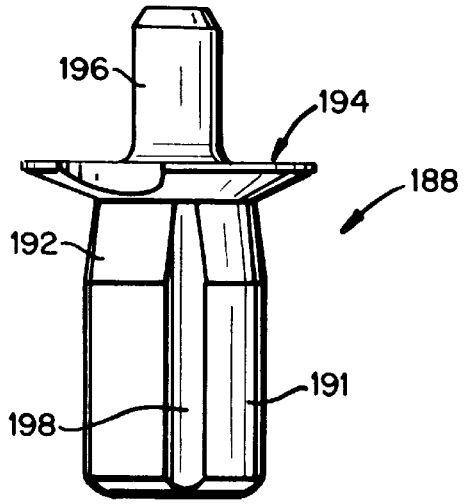
FIG. 20
FIG. 21
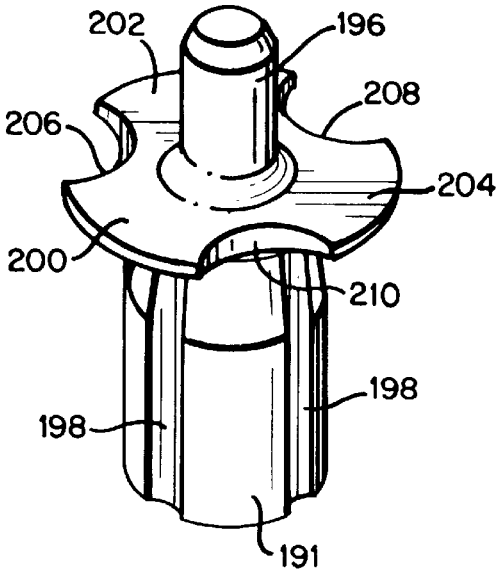
FIG. 22
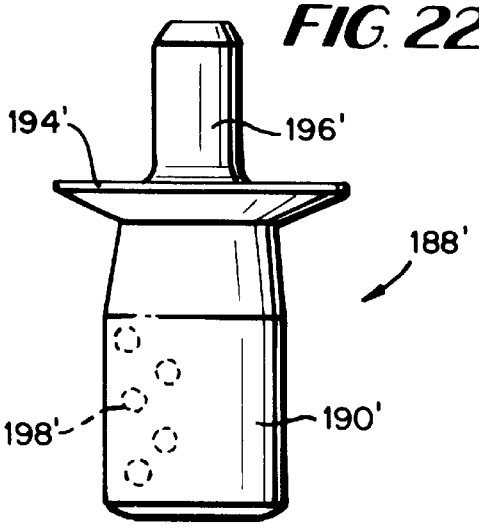
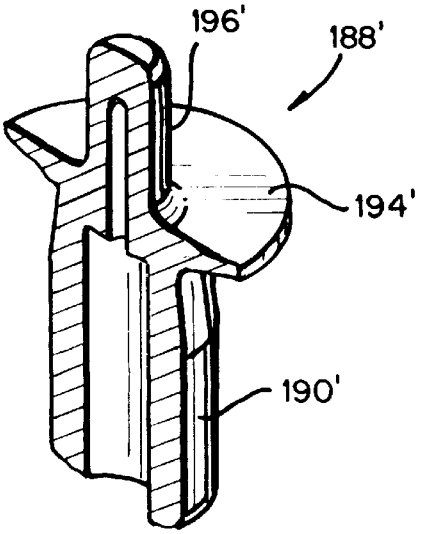
FIG. 23

ROTATOR AIR MANAGEMENT SYSTEM

TECHNICAL FIELD

This invention relates primarily to irrigation sprinklers having stream driven rotor plates utilizing viscous dampening for controlling the rotational speed of the rotor plates.

BACKGROUND AND SUMMARY OF THE INVENTION

Current viscous-damped rotator design and technology employ a cylindrical or conical rotor attached to a shaft that rotates within a housing having a cylindrical or conical chamber (rotor cavity) that is filled with a viscous fluid (this device is sometimes referred to as a "rotor motor"). The rotor motor acts as a brake or dampener to control the rotational speed of the stream distribution or rotor plate. The dampening or resistance that impedes rotation comes from the high forces required for shearing the viscous fluid molecules. This shearing takes place between a moving boundary layer, (molecules of fluid attracted to the rotor surface), and stationary neighboring fluid molecules (molecules attracted to the stator or housing surface) in the rotor cavity.

If the viscous fluid molecules separate from neighboring molecules and a less viscous foreign substrate fills the gap between molecules, the rotor may become free spinning, i.e., it may rotate at a speed approaching that which would occur in the absence of any viscous dampening. In the rotor cavity, air is the predominant substrate that may fill this thin gap. It is believed that as the rotor turns, air in the rotor cavity begins to thinly distribute itself all the way around the rotor until it grows large enough (or spreads itself thin enough) to separate the viscous fluid molecules all around the cylindrical surface of the rotor. In effect, a cylindrical sleeve of air is formed in the much thicker viscous fluid. The result is that the viscous fluid molecules no longer shear, and the dampening or braking effect becomes negligible.

An obvious solution would be to prevent air from ever entering the rotor housing and, more specifically, the rotor cavity. This however has proven to be unobtainable and probably not practical. Moreover, closer evaluation and testing has shown that very small amounts of air are of little consequence. The real problem comes to light when there is too much air present, and at the wrong location within the rotor cavity. In fact, the volume of air is less significant than its location within the cavity. For example, a large bubble at the top of the cavity is not a problem, but a smaller air volume "smeared" around the rotor may indeed be problematic. The goal then is two-fold: to have as little air as possible in the rotor cavity, and then to manage any air that is present. This invention focuses on the management of air present within the rotor cavity.

A first air management technique incorporates air management features into the rotor design per se. Movement of the air is accomplished by manipulating the geometry of the rotor. It has been discovered that changing the geometry of the rotor to have one or more fins protruding outwardly to a point closely adjacent the interior surface of the housing, i.e., the surface defining the rotor cavity, appears to manage most of the air in an efficient manner. As the rotor rotates, high and low pressure areas are created in front of and behind the rotor fins respectively. The much thinner air rushes to the low pressure area behind the rotor fin and trails in this low pressure wake. By staying in this wake as the rotor rotates, the leading edge of the rotor is able to penetrate pure viscous fluid, maintaining an area of fluid-to-fluid shearing, resulting in the dampening required for proper rotation. Over an extended period of usage, however, fluid can leak out leaving air/water in its place. In the event the volume of air is large enough to fill the entire low pressure area behind all elements of the rotor, thus allowing the leading edge to hit air rather than fluid, the result will be the loss of the viscous fluid shearing. Further refinement of the rotor design reveals that non-symmetrical fins will further enhance the volume of air that can be managed. By making one of two fins shorter, air traveling in the shorter fins radial wake has been moved inward, away from the path of the approaching longer fin. This results in the longer fin penetrating the fresh fluid required for proper shearing.

A third variation of this method utilizes a cylindrical rotor with one or more recesses to create low pressure pockets for the air to be contained. This can range from large lengthwise grooves or pockets to many thin shallow grooves or even dimples.

A second air management technique utilizes a rotating disk inside the rotor cavity. The disk could be a part of the rotor or axially spaced from the rotor. This disk acts as a "decoy," i.e., it attracts air to its surface rather than to the rotors surface. By making the disk's major diameter larger than the rotor, the disk has an increased shear rate due to its higher velocity, which produces a higher rate of boundary layer separation. This separation appears to create small eddy currents near the disk surface that attract the air. Air is thus continuously attracted to the moving disk the entire time rotation is occurring, allowing the desired viscous shearing to occur in the area between the rotor body and the housing surface. Perforating the thin disk also helps more air to be managed by creating small, low pressure pockets that attract and capture air as the disk rotates.

In the detailed description which follows, several different rotor designs are described, each of which is designed to efficiently manage air inside the rotor cavity so as not to degrade the viscous dampening function of the rotor motor.

Testing has shown that with this invention, a rotor will still operate properly with just 50% of the original fluid volume. This is most significant with micro rotators due the difficulty of purging all air from the small rotor housing during assembly.

Accordingly, in one aspect, the invention relates to an improvement in a rotary sprinkler comprising a nozzle and a rotatable stream distributor plate secured to one end of a shaft, wherein rotational speed of the stream distributor plate is controlled by a viscous damping arrangement including a rotor body on an opposite end of the shaft and located within a chamber at least partially filled with a viscous fluid, and wherein the rotor body is rotatable relative to a stator; the improvement wherein a disk is mounted within the chamber for rotation with the rotor body, the disk having an outside diameter greater than an outside diameter of the rotor body.

In another aspect, the invention relates to an improvement in a rotary sprinkler comprising a nozzle and a rotatable stream distributor plate, wherein rotational speed of the stream distributor plate is controlled by a viscous damping arrangement including a rotor arranged within a chamber at least partially filled with a viscous fluid, and wherein the rotor is rotatable relative to a stator; the improvement wherein the rotor includes a hub and at least one fin projecting therefrom.

In still another aspect, the present invention relates to a rotational speed viscous dampening device comprising a housing, a shaft having one end located in the housing and rotatable relative thereto, and a rotor body on the one end of the shaft with viscous fluid at least partially filling the housing, the improvement comprising means for managing air within the housing so that the air does not substantially interfere with viscous shearing of molecules of the viscous fluid between the rotor body and an interior wall of the housing.

In still another aspect, the invention relates to a rotary sprinkler comprising a nozzle and a rotatable stream distributor plate secured to one end of a shaft, wherein rotational speed of the stream distributor plate is controlled by a viscous damping arrangement including a rotor on an opposite end of the shaft and arranged within a chamber at least partially filled with a viscous fluid, and wherein the rotor is rotatable relative to a stator; the improvement wherein the rotor includes a center hub with an annular disk at one end thereof, and a fin extending axially along the center hub between the disk and an opposite end of the center hub.

In still another aspect, the invention relates to a rotary sprinkler comprising a nozzle and a rotatable stream distributor plate secured to one end of a shaft, wherein rotational speed of the stream distributor plate is controlled by a viscous damping arrangement including a rotor on an opposite end of the shaft and arranged within a chamber at least partially filled with a viscous fluid, and wherein the rotor is rotatable relative to a stator; the improvement wherein the rotor includes one or more air accumulating pockets formed therein.

Other features of the invention will become apparent from the detailed description which follows.

BRIEF DESCRIPTION OF THE DRAWINGS

FIG. 7 is a plan view of a rotor in accordance with a third embodiment of the invention;

FIG. 8 is a perspective view of the rotor shown in FIG. 7;

FIG. 9 is a plan view of a rotor in accordance with a fourth embodiment of the invention;

FIG. 10 is a perspective view of the rotor shown in FIG. 9;

FIG. 15 is a plan view of a rotor in accordance with a seventh exemplary embodiment of the invention;

FIG. 16 is a perspective view of the rotor shown in FIG. 15;

FIG. 17 is a partial section of a sprinkler assembly showing a rotor and disk in accordance with an eighth exemplary embodiment of the invention;

FIG. 20 is a side elevation of the rotor shown in FIG. 19;

FIG. 21 is a perspective view of the rotor shown in FIG. 20;

FIG. 22 is a side elevation of a rotor in accordance with a tenth exemplary embodiment of the invention;

FIG. 23 is a perspective view, partly in section, of the rotor shown in FIG. 22;

DETAILED DESCRIPTION OF THE DRAWINGS

Figure 1:
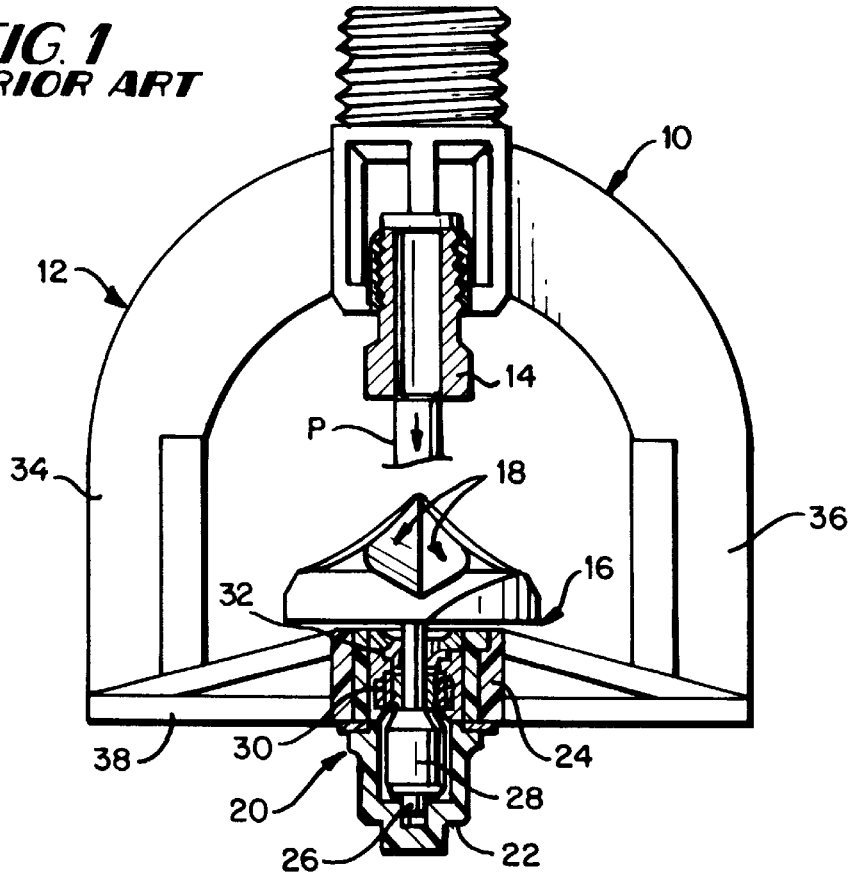
FIG. 1 PRIOR ART
FIG. 1 is a side elevation, partly in section, of a known sprinkler assembly incorporating a viscous rotor.

Referring to FIG. 1, a conventional sprinkler head 10 is shown as an example of the type of sprinkler for which the present invention is particularly applicable. It should be understood, however, that this invention is not limited to the sprinkler construction shown in FIG. 1, but is applicable to a wide variety of rotating sprinklers and other devices which make use of a viscously damped rotating shaft. The sprinkler 10 includes a sprinkler body 12 which is a static structure adapted to be connected to a source of water under pressure. An outlet nozzle 14 is secured to the sprinkler body 12 so as to direct the water under pressure into an atmospheric condition as a primary stream P having a generally vertically extending axis. The sprinkler head 10 also includes a rotary distributor plate 16 which is mounted for rotation about an axis coaxially aligned with the nozzle axis. The distributor plate 16 includes surface means generally indicated at 18 for engaging the primary stream and which establish a reactionary force component acting on the plate in a direction tangential to the rotational axis thereof so as to effect rotation of the plate about its axis, and to direct the primary stream P engaged thereby in the form of a predetermined pattern away from the distributor plate in a substantially radial outward direction.

The sprinkler head 10 also includes a speed reducing assembly 20 operatively associated with the distributor plate 16 for reducing the rotational speed of the plate from a relatively high speed which would occur absent the speed reducing assembly, to a relatively slow, controlled speed which maximizes the radial "throw" of the stream.

The speed reducing assembly 20 includes a cup-shaped housing 22 fixed within a cylindrical mounting portion 24 of the sprinkler. This cup-shaped housing defines a rotor cavity for the rotor as described below. The end wall of the cup-shaped housing 22 is apertured to receive one end of a shaft 26, the opposite end of which is connected to the distributor plate 16. Fixed to the shaft 26 above its lower end is an enlarged fluid damping rotor 28 having a diameter which leaves only a small space between the rotor and the interior surface of the housing. A ball bearing 30 serves to rotatably mount a portion of the shaft extending above the rotor. A flexible lip seal 32 is mounted above the ball bearing in a position to engage the periphery of the shaft thereabove. The entire interior of the cup-shaped housing 22 is filled or at least partially filled with a viscous fluid, preferably a silicone fluid. Speed retardation is achieved by frictional contact, i.e., viscous shearing, of the molecules of the viscous fluid between the moving rotor 28 and the fixed housing or stator 22. It will be understood that by changing the viscosity of the fluid, the extent of speed reduction can be controlled in a predetermined manner. It should also be noted here that references to one component "above" another, or to orientation of the sprinkler in general are merely for convenience and understanding, as they relate to the drawing figure. In use, the sprinkler may be oriented differently, for example, it may be inverted from the orientation in FIG. 1.

In the illustrated sprinkler, the speed reducing assembly (or motor) 20 is supported in axially spaced relation to the nozzle 14 by means of spaced struts 34, 36 which are joined to the sprinkler body near the nozzle 14 and which are connected by a horizontal cross brace 38 which, in turn, supports the mounting portion 24 for the speed reducing assembly 20. The rotor 28 in the illustrated sprinkler is of conventional construction and subject to the air management problems discussed above.

In accordance with this invention, new rotor configurations are presented which "manage" the air present within the rotor housing and which might otherwise degrade the rotational speed reduction characteristics of the device.

Figure 2:
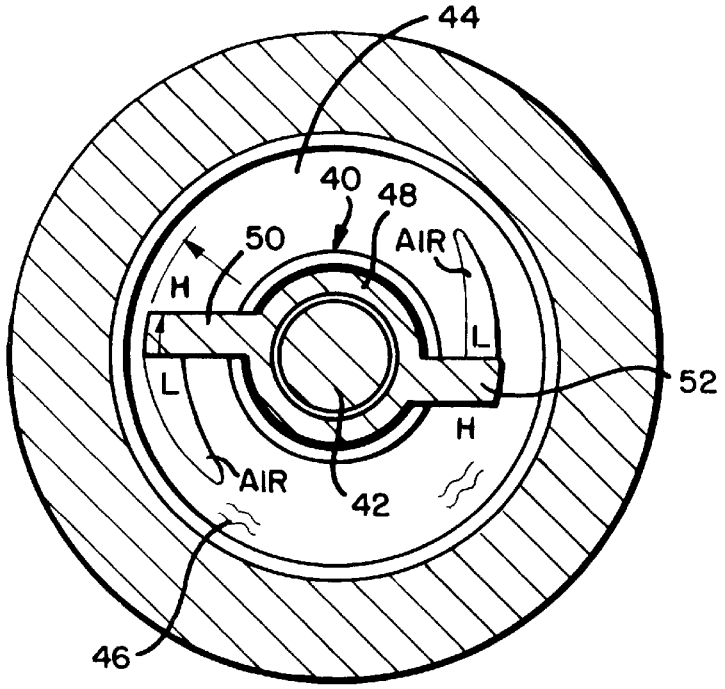
FIG. 2 is a cross section of a rotor housing and rotor in accordance with this invention.
Figure 3:
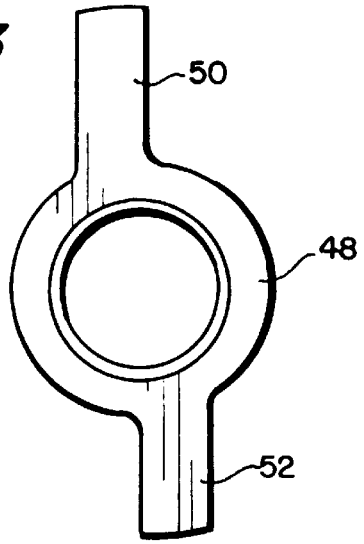
FIG. 3 is a plan view of a rotor in accordance with a first exemplary embodiment of the invention.

FIG. 2 illustrates a sectional plan view of a rotor 40 in accordance with a first exemplary embodiment of this invention mounted on a shaft 42 secured at one end within a rotor cavity 44 at least partially (and preferably substantially) filled with a viscous fluid 46. The rotor 40 includes a center hub or rotor body 48 and a pair of outwardly projecting fins or paddles 50, 52. These fins do not project radially from the center axis of the shaft 42, but rather, are offset from the shaft axis as apparent from the Figure. The rotor configuration is shown more clearly in FIGS. 3 and 4, but FIG. 2 illustrates the way in which the rotor manages the air present in the motor cavity. As the rotor 40 rotates, high and low pressure areas (designated H and L, respectively) are created in front of and behind the rotor fins 50, 52. The much thinner air rushes to the low pressure area behind the rotor fins and trails in this low pressure wake. By keeping the air in this wake as the rotor rotates, the leading edges of the rotor fins are able to penetrate pure viscous fluid, thus maintaining an area of fluid-to-fluid shearing between the fins and the interior housing surface, thereby providing the desired viscous dampening effect necessary for proper speed rotation control. A further refinement of this design includes making one of the two fins (fin 52) shorter, so that air traveling in the radial wake of the shorter fin 52 is moved inwardly, closer to the center of the hub 48, and away from the path of the approaching longer fin 50. This will insure that the longer fin 50 penetrates fresh viscous fluid necessary for good viscous shearing action even when more significant amounts of air are in the cavity.

Figure 4:
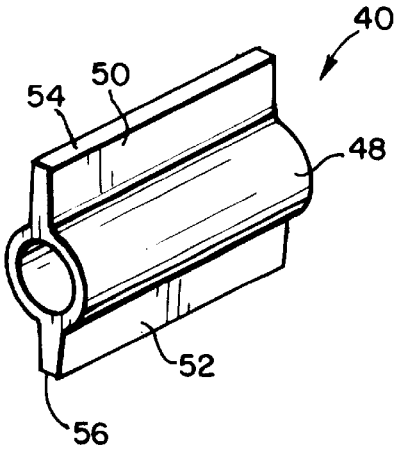
FIG. 4 is a perspective view of the rotor illustrated in FIG. 3.

As best seen in FIG. 4, the fins 50, 52 extend the full length of the center hub 48 of the rotor. In this embodiment, the rotor may have an axial length of about 0.19 inch, and each fin has a width of about 0.0180 inch. Outer edges 54, 56 of fins 50, 52, respectively, have radii from about 0.0680–0.0775 inch. The center hub (or rotor body) 48 has an OD of about 0.0700 inch and an ID of about 0.0450 inch. These dimensions are applicable to very small micro-sprinklers and may vary considerably with the size of the sprinkler and speed reducing assembly.

Figure 5:
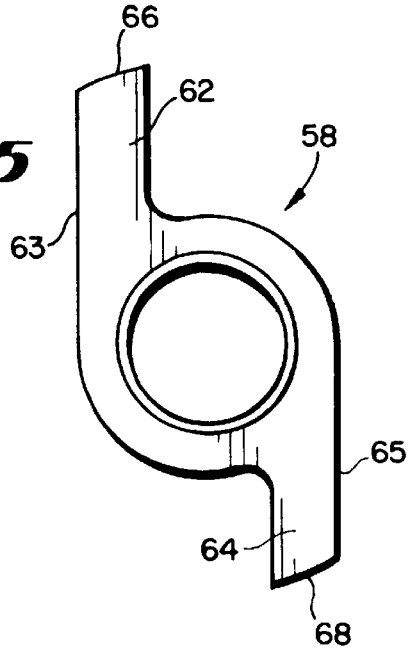
FIG. 5 is a plan view of a rotor in accordance with a second embodiment of the invention.
Figure 6:
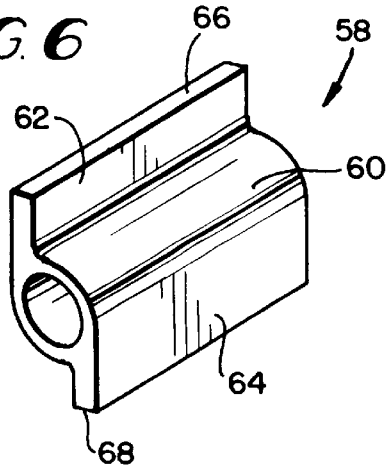
FIG. 6 is a perspective view of the rotor shown in FIG. 5.

FIGS. 5 and 6 illustrate a second rotor embodiment, the rotor 58 including a center hub (or rotor body) 60 and a pair of fins 62, 64 which, again, are offset from the hub center axis. In fact, in this embodiment, the leading edges 63, 65 of the fins 62, 64 extend tangentially away from the center hub so that the leading edges are necessarily longer than the trailing edges but, in addition, fin 62 is longer per se than fin 64. Outer edges 66, 68 of the fins 62, 64, respectively, are also radiused and the dimensions of this rotor are generally similar to those of the previously described embodiment.

FIGS. 7 and 8 illustrate a rotor 70 including a center hub (or rotor body) 72 and outwardly projecting fins 74, 76. The fins are offset from the center axis of the rotor to an extent generally similar to the embodiment in FIG. 3. The fins have straight leading edges 78, 80, respectively, along with undercut trailing edges 82, 84. The outermost edges of the fins have two radiused portions 86, 88 and 90, 92, respectively drawn on different centers. Here again, the length of the fins also varies, with the distance from the center hub to the outermost edge of fin 80 being about 0.0760 inch, while the same dimension for fin 66 is 0.709 inch.

Turning to FIGS. 9 and 10, the rotor 94 includes a center hub portion (or rotor body) 96 and three fins 98, 100 and 102 spaced equally circumferentially about the hub 96, but offset from the center axis of the rotor. The fins project an equal distance from the center hub and include substantially straight leading and trailing edges 104, 106, respectively. The outer edges 108 of the fins are slightly radiused to conform generally to the curvature of the housing. In addition, because the leading edges 104 are tangential to the center hub 96, and the trailing edges 106 are radially aligned with the axis of the hub, the leading edges are effectively longer than the trailing edges. With this arrangement, the wake behind the trailing edges 106 is closer to the center hub, insuring that the leading edge 104 of the next fin will penetrate fluid only.

Figure 11:
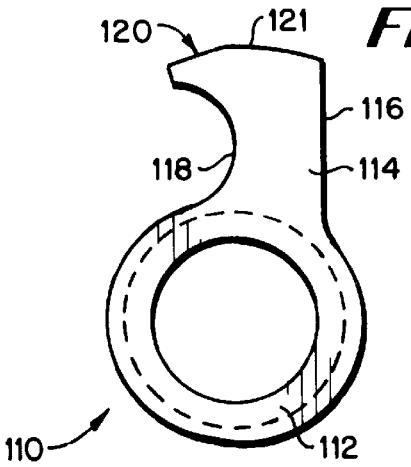
FIG. 11 is a plan view of a rotor in accordance with a fifth exemplary embodiment of the invention.
Figure 12:
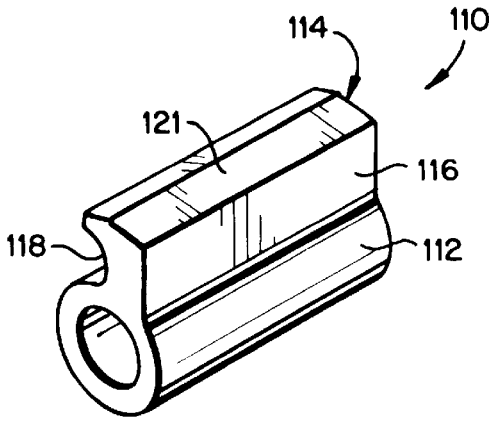
FIG. 12 is a perspective view of the rotor shown in FIG. 11.

FIGS. 11 and 12 illustrate yet another rotor configuration. In this version, the rotor 110 has a center hub (or rotor body) 112 and a single projecting fin 114, slightly offset from the center axis of the hub. The fin 114 has a straight leading edge 116 and a radiused trailing edge 118, with a hook-like end 120, including a compound radiused edge 121. With this arrangement, a low pressure area is formed behind the edge 118 so that, again, the leading edge 116 will penetrate viscous fluid only. It will be understood that the fins or paddles (or projections) may extend radially, however, and still perform the desired air management function.

Figure 13:
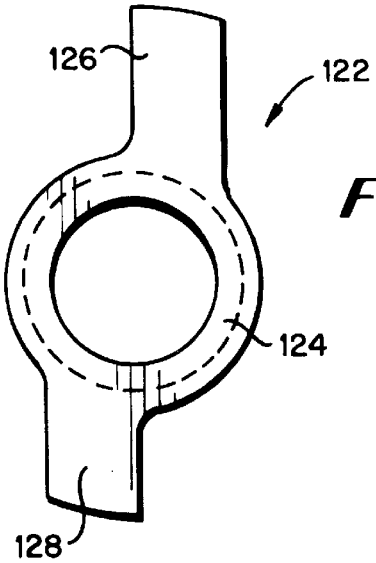
FIG. 13 is a plan view of a rotor in accordance with a sixth exemplary embodiment of the invention.
Figure 14:
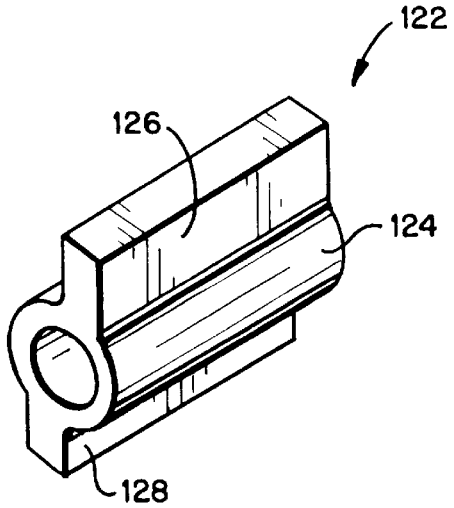
FIG. 14 is a perspective view of the rotor shown in FIG. 13.

Turning to FIGS. 13 and 14, a rotor 122 is shown which includes a center hub (or rotor body) 124 and a pair of fins 126, 128 offset from the center axis of the hub, with fin 128 projecting a lesser distance from the center axis of the hub than fin 126. This rotor is substantially similar to the rotor illustrated in FIGS. 3 and 4 with the exception that the width of each fin has been increased from approximately 0.018 inch to 0.025 inch.

FIGS. 15 and 16 disclose another rotor construction 130 which includes a center hub (or rotor body) 132 and a pair of fins 134 and 136. The fins extend an equal distance from the center axis of the rotor hub, and fin 136 is substantially radially aligned with the center axis of the hub. Fin 134, on the other hand, is slightly offset from the hub axis and has a substantially lesser width. Otherwise, the fins are similar, with straight leading edges 138, 140 and radiused or undercut trailing edges 142, 144. Again, the low pressure zone created in the trailing edge undercuts attracts and captures the air and assures good dampening action.

FIGS. 17–28 illustrate embodiments which combine rotor design and decoy techniques to achieve the desired air management goal.

Figure 18:
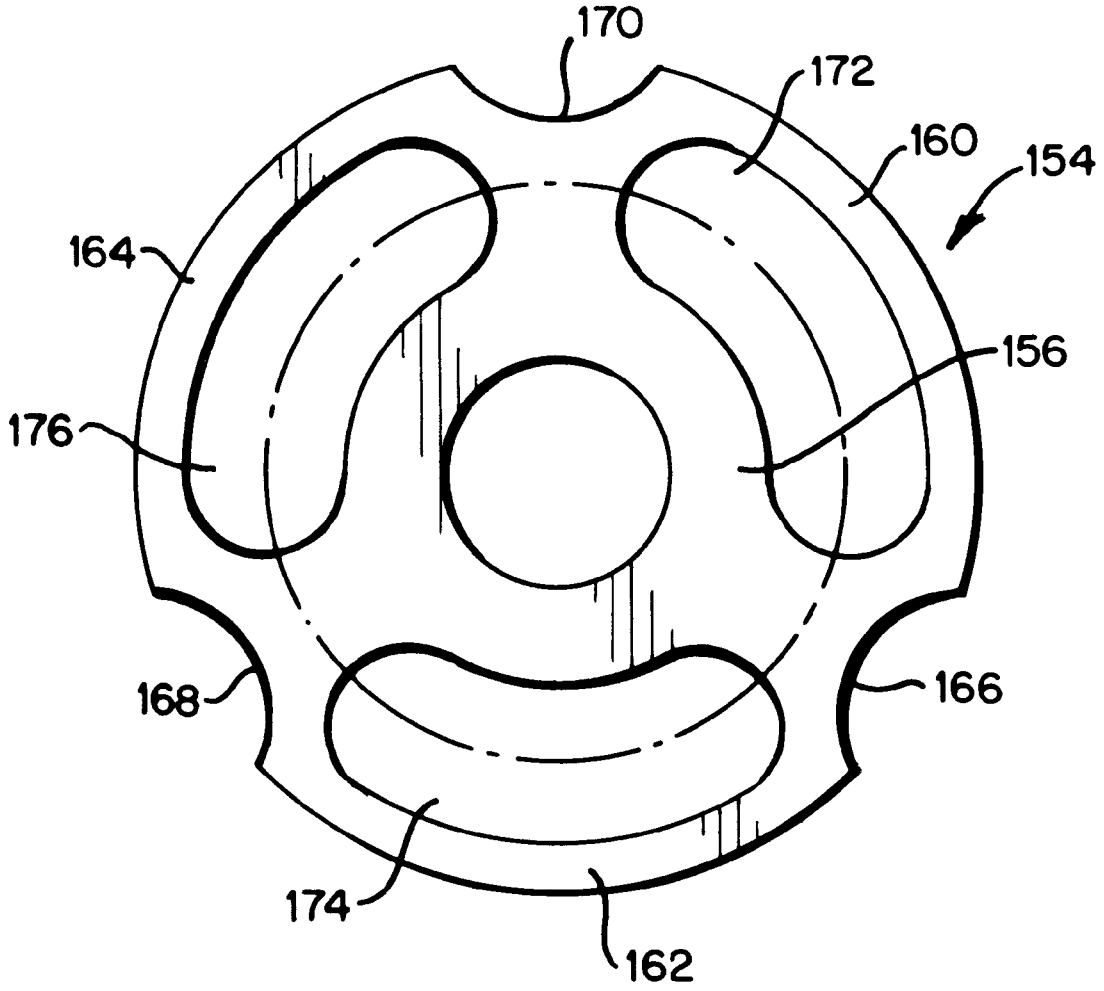
FIG. 18 is a partial plan view of the disk shown in FIG. 17.

FIG. 17 illustrates a rotor construction 146 located within a motor housing 148. The rotor 146 includes a substantially cylindrical main rotor body 150 integrally formed with a shaft 152. Above the rotor body 150, there is an integral, apertured disk 154, the details of which are best seen in FIG. 18. The disk 154 has a center hub portion 156 with a conical taper 158 (FIG. 17) at its lower end with three equally spaced radial projections 160, 162 and 164, which are shaped as part annular segments. The outer circumferential edges of the projections have radii substantially similar to the interior diameter of the motor housing 142, to maximize the diametric difference between the hub or rotor body 150 and the projections 160, 162 and 164. Radiused recesses 166, 168 and 170 separate the projections. At the same time, each of the projections is formed with an elongated aperture, 172, 174 and 176, respectively. The disk design, with a larger diameter than the rotor body, in combination with the projections 160, 162 and 164, cutouts 166, 168 and 170 along with apertures 172, 174 and 176 attract and capture whatever air is present in the rotor cavity, assuring good viscous shearing performance in the viscous fluid between the rotor body 150 and the housing wall.

Figure 19:
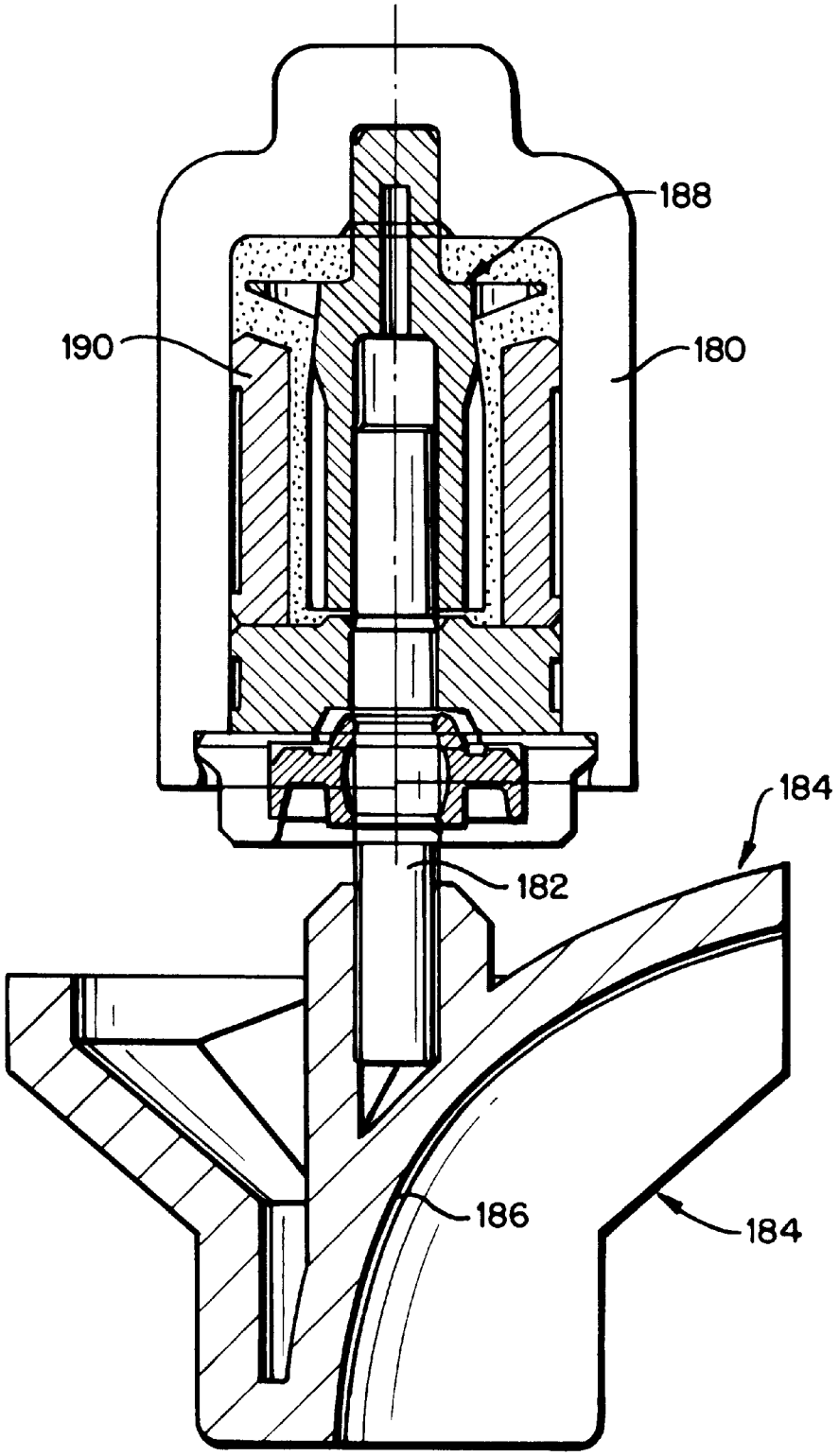
FIG. 19 is a side elevation, partly in section, of a sprinkler assembly incorporating a rotor in accordance with a ninth exemplary embodiment of the invention.

FIG. 19 illustrates a variation of the rotor shown in FIGS. 17 and 18. More specifically, FIG. 19 illustrates a micro-sprinkler which includes a rotor motor housing 180, with a rotor shaft 182 projecting out of the housing and mounting at its free end a rotary stream distributor or plate 184. It will be understood that the sprinkler body (not shown) includes a nozzle which directs a stream to atmosphere which impinges upon the groove 186 in the plate 184, the groove configured to impart rotation to the plate 184 to thereby distribute the stream in the manner essentially as described in connection with FIG. 1. The speed of rotation of the plate is reduced by the viscous damping arrangement within the rotor motor housing 180. Specifically, the shaft 182 mounts a rotor 188 which rotates along with the shaft, in relatively close alignment to an interior stator 190. Details of the rotor are best seen in FIGS. 20 and 21.

The rotor 188 includes a generally cylindrical body portion 191 with a tapered region 192 extending upwardly to a disk member 194, with an upper shaft extension portion 196 adapted to be secured within the rotor motor housing as shown in FIG. 19. The cylindrical portion 190 and tapered portion 192 of the rotor 188 are formed with three axially extending grooves 198 (two shown) extending upwardly to the disk 194. The latter is formed with three radially outward extending projections 200, 202 and 204, each of which has outer circumferential edges which conform generally to the interior surface of the rotor motor housing. In addition, the projections are separated by curved cut-out or recessed portions 206, 208 and 210. Here again, the disk 194 attracts air, creating wakes behind the cut-outs, decoying air away from the main body 190 of the rotor. Grooves 198 provide even greater assurance of good viscous shearing by providing additional space for air to accumulate. Alternatives to the grooves 198 include numerous shallow grooves, dimples (see 198' in FIG. 22) or the like, all of which are designed to capture air.

FIGS. 22 and 23 illustrate a variation of the rotor shown in FIGS. 20 and 21 with similar reference numerals used to designate corresponding components, but with the prime designation added. The difference between the two rotors is that the disk 194' is solid, i.e., there are no discrete projections separated by cut-outs as in the rotor shown in FIGS. 20 and 21, and there are no axial grooves along the rotor body. Optional dimples 198' are shown in phantom.

Figure 24:
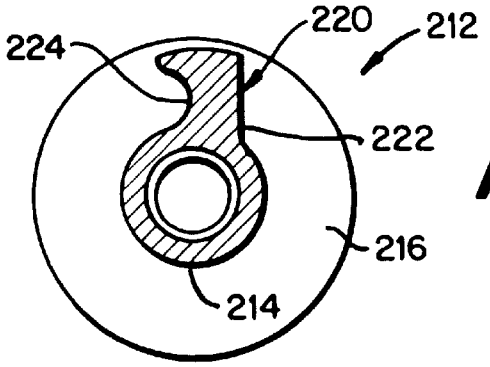
FIG. 24 is a plan view, partly in section, of a rotor in accordance with an eleventh exemplary embodiment of the invention.
Figure 25:
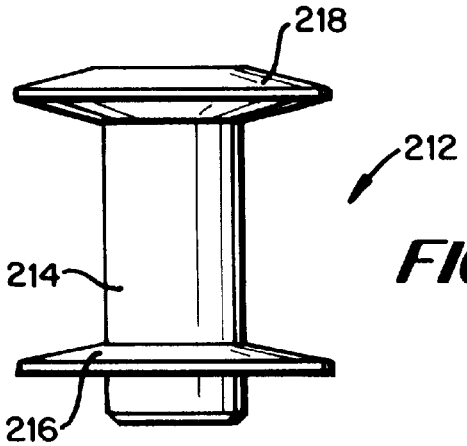
FIG. 25 is a side elevation of the rotor shown in FIG. 24.
Figure 26:
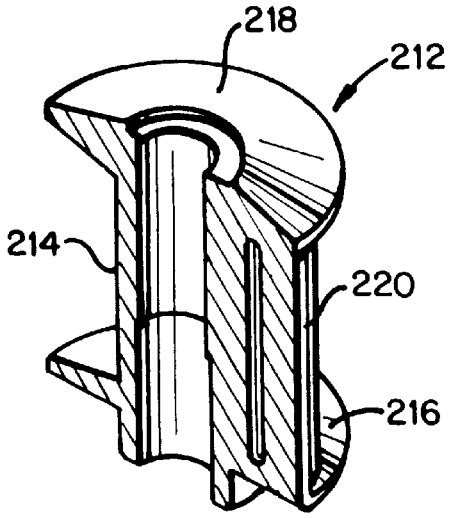
FIG. 26 is a perspective view, partly in section, of the rotor illustrated in FIGS. 24 and 25.

Turning now to FIGS. 24–26, an alternative rotor construction 212 includes a cylindrical center hub portion 214 with a lower solid disk portion 216 and an upper solid disk portion 218. Extending between the two circular disk portions, there is a single fin or projection 220 which, as best seen in FIG. 24, is slightly offset from the center axis of the rotor. Fin 220 includes a straight leading edge 222 and a curved undercut trailing edge 224 substantially similar to the fin 104 shown in FIG. 11.

Figure 27:
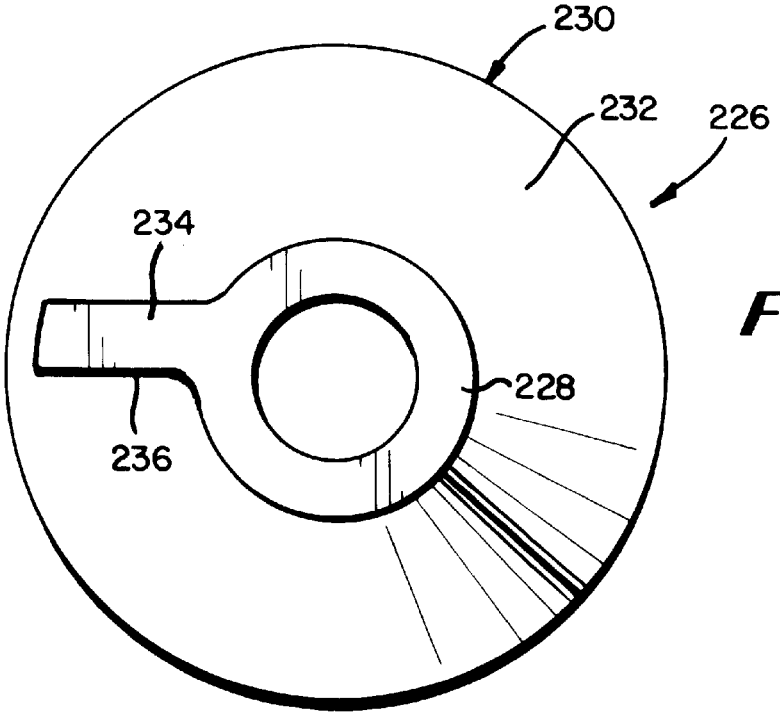
FIG. 27 is a plan view of a rotor in accordance with a twelfth exemplary embodiment of the invention.
Figure 28:
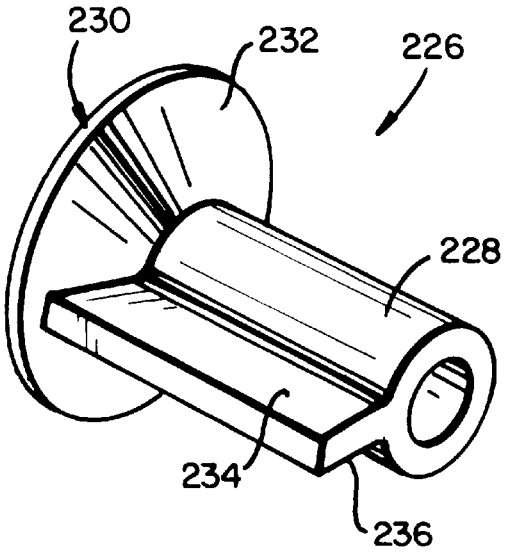
FIG. 28 is a perspective view of the rotor shown in FIG. 27.

FIGS. 27 and 28 show a rotor construction somewhat similar to the rotor construction shown in FIGS. 24–26 but wherein the upper circular disk is omitted. More specifically, the rotor 226 includes a generally cylindrical center hub 228, the lower end of which mounts a circular disk 230 having a generally conical upper surface 232. A single fin 234 extends along the length of the center hub 228 from the disk 230 through the upper end of the cylindrical portion. The single fin 234 projects outwardly from the center hub, slightly offset from the center axis of the rotor and has a length less than the radius of the disk 230 as best seen in FIG. 27. Air present within the motor cavity will be attracted to the disk 230 and/or to a location behind the trailing edge 236 of fin 234.

It will be appreciated that in each of the described embodiments, effective air management is achieved which minimizes the otherwise undesirable consequences of air in the rotor motor cavity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary sprinkler comprising a nozzle and a rotatable stream distributor plate secured to one end of a shaft, wherein rotational speed of the stream distributor plate is controlled by a viscous damping arrangement including a rotor on an opposite end of the shaft and located within a chamber at least partially filled with a viscous fluid, and wherein the rotor is rotatable relative to a stator; wherein said rotor includes a substantially cylindrical center hub; a disk mounted to said center hub at one end thereof for rotation with said rotor, said disk having an outside diameter greater than an outside diameter of said center hub; and a fin projecting from said center hub extending axially along said center hub and projecting outwardly a distance less than a radius of said disk.

2. The rotary sprinkler of claim 1 wherein said disk increases in thickness from said outside diameter toward said center hub.

3. The rotary sprinkler of claim 1 wherein said disk is integral with said center hub.

4. A rotary sprinkler comprising a nozzle and a rotatable stream distributor plate secured to one end of a shaft, wherein rotational speed of the stream distributor plate is controlled by a viscous damping arrangement including a rotor on an opposite end of the shaft and arranged within a chamber at least partially filled with a viscous fluid, said rotor being rotatable relative to a stator; and further wherein said rotor includes a center hub and at least one fin projecting therefrom, said fin offset from a center axis of said rotor.

5. A rotary sprinkler comprising a nozzle and a rotatable stream distributor plate secured to one end of a shaft, wherein rotational speed of the stream distributor plate is controlled by a viscous damping arrangement including a rotor on an opposite end of the shaft and arranged within a chamber at least partially filled with a viscous fluid, said rotor being rotatable relative to a stator; and further wherein said rotor includes a center hub with an annular disk at one end thereof, and a fin extending axially along said center hub between said disk and an opposite end of said center hub.

6. The rotary sprinkler of claim 5 wherein said fin projects outwardly from said center hub a distance less than a radius of said disk.

* * * * *